US009570851B2

(12) United States Patent
Rauscent et al.

(10) Patent No.: US 9,570,851 B2
(45) Date of Patent: Feb. 14, 2017

(54) CONNECTOR TECHNOLOGY FOR EMBEDDED ELECTRONIC EQUIPMENT WITH TWO CONNECTORS

(71) Applicant: THALES, Courbevoie (FR)

(72) Inventors: Eric Rauscent, Lormont (FR); Erick Moreaud, Pessac (FR); Jean-Marie Goy, Gradignan (FR)

(73) Assignee: Thales, Courbevoie (FR)

( * ) Notice: Subject to any disclaimer, the term of this patent is extended or adjusted under 35 U.S.C. 154(b) by 0 days.

(21) Appl. No.: 15/068,501

(22) Filed: Mar. 11, 2016

(65) Prior Publication Data

US 2016/0268735 A1 Sep. 15, 2016

(30) Foreign Application Priority Data

Mar. 13, 2015 (FR) ..... 15 00483

(51) Int. Cl.
*H01R 13/631* (2006.01)
*H01R 12/91* (2011.01)
*H01R 13/74* (2006.01)

(52) U.S. Cl.
CPC ..... *H01R 13/6315* (2013.01); *H01R 12/91* (2013.01); *H01R 13/74* (2013.01)

(58) Field of Classification Search
CPC ..... H01R 12/91; H01R 13/74; H01R 13/6315
USPC ..... 439/246, 247, 248
See application file for complete search history.

(56) References Cited

U.S. PATENT DOCUMENTS 3,094,364 A * 6/1963 Liagg ..... H01R 13/629 285/154.1
5,622,511 A 4/1997 Jarrett
6,261,122 B1 * 7/2001 Richter ..... H01R 33/7664 439/477
6,346,007 B2 * 2/2002 Yokoi ..... H01R 13/748 439/248

(Continued)

FOREIGN PATENT DOCUMENTS

EP 2 065 985 A2 6/2009

OTHER PUBLICATIONS

French Search Report for corresponding French Patent Application No. 1500483, 7 pp., (Nov. 26, 2015).

*Primary Examiner* — Tulsidas C Patel
*Assistant Examiner* — Travis Chambers
(74) *Attorney, Agent, or Firm* — Blakely, Sokoloff, Taylor & Zafman LLP

(57) ABSTRACT

The general field of the invention is that of the devices for connecting an electronic module in a rack comprising an opening of dimensions close to those of the front face of the module and a seat for fixing and connecting said module, said connection device comprising a first and a second male connector mounted on the rear face of the electronic module; and a first and a second female connector mounted on the fixing seat. In the device according to the invention, the second female connector is mounted in a structure comprising mechanical means for self-centring said second female connector within a clearance range greater than the mechanical positioning tolerances and elastic means arranged so as to hold said second female connector in position. These various means are arranged in such a way as to be able to ensure the blind electrical connection of the electronic module in the rack, its front face resting on the opening.

4 Claims, 4 Drawing Sheets

(56) References Cited

U.S. PATENT DOCUMENTS

| | | | | |
|---|---|---|---|---|
| 6,450,822 | B1 * | 9/2002 | Eller | H01R 13/6315 439/247 |
| 7,121,857 | B1 * | 10/2006 | Lewis | H01R 13/6315 439/247 |
| 8,894,431 | B2 * | 11/2014 | Tiberghien | F16L 37/56 439/247 |
| 8,992,241 | B2 * | 3/2015 | Genest | H01R 13/627 439/248 |
| 2002/0081881 | A1 | 6/2002 | Komenda et al. | |
| 2007/0111575 | A1 * | 5/2007 | Jensen | H01R 13/6315 439/246 |
| 2013/0065415 | A1 * | 3/2013 | Van Swearingen | H01R 24/38 439/247 |
| 2014/0315408 | A1 * | 10/2014 | Colapietro | H01R 13/46 439/247 |

* cited by examiner

CONNECTOR TECHNOLOGY FOR EMBEDDED ELECTRONIC EQUIPMENT WITH TWO CONNECTORS

FIELD

The field of the invention is that of the electrical and mechanical connection devices for electronic equipment in racks making it possible to ensure a secure connection. The preferred field of application is that of aeronautics and in particular that of the aircraft instrument panels comprising a number of display screens. However, this device can have a large number of applications, particularly in all the fields of professional electronics which require secure connections.

BACKGROUND

The mounting of an electronic equipment item on an aeronautical instrument panel is represented schematically in FIG. 1. The rear part of the equipment item 1 comprises a first male connector 10. The instrument panel 2 comprises an opening 20. At the rear of this opening 20, the instrument panel comprises a fixed rack or "seat" 3 comprising a first female connector 30, complementing the first male connector 10. These connectors generally comprise several dozen contacts and, consequently, installing them involves both great accuracy and a certain insertion force. The instrument panel also comprises mechanical translational guiding means making it possible to correctly pre-position the equipment item 1 when it is to be fixed to the instrument panel 2. These means are not represented in FIG. 1. Once positioned on the instrument panel, the equipment item is generally locked by means of a fixing handle which ensures both the mechanical fixing of the equipment item 1 and the securing of the electrical contact between the two connectors 10 and 30.

Currently, there are various mechanical and electrical connection systems that make it possible to ensure this equipment mounting in safe electrical and mechanical conditions and conditions to withstand the environments required for the aeronautical equipment items. These systems also meet specific requirements of instrument panel mounting notably regarding ease and speed of mounting.

For a certain number of applications, notably when the equipment item is a display device comprising a removable touch surface, it is necessary for the equipment item to comprise a second male connector independent of the first connector. This second connector, for sitting reasons, is not necessarily either close to or situated in the same plane as the first connector. Consequently, it is very difficult to impose positioning and mounting tolerances such that they allow for the simultaneous mounting of the first connector and of the second connector.

One possible solution for mounting this second connector is represented in FIG. 2. It consists in mounting the male part 11 of the second connector on the rear part of the equipment item 1 and in mounting the female part 31 on a strand 41 that is elastic or mounted, for example, on a winder so as to be able to extract the female part 31 from the seat 3. The connecting of the connectors 11 and 31 is then done, outside the seat, before the equipment item 1 is mounted in said seat 3.

This solution has a number of drawbacks. The mounting of the connector 31 on the strand 41 is not necessarily simple given the weight of the strand and the pulling forces exerted on the connector 31 at the time of connection. Since the mounting of the equipment item is done blind, it is impossible to know whether the strand 41 is positioned correctly at the rear of the equipment item when the equipment item is mounted on the panel 2. Moreover, if precautions are not taken, the second connector set risks being damaged on extraction of the equipment item. Finally, this solution is relatively costly and the mounting of the second connector results in a significantly longer equipment mounting time.

SUMMARY

The connection device according to the invention does not present these drawbacks. It notably avoids having a strand on the connector with all the drawbacks that that represents. More specifically, the subject of the invention is a device for electrically and mechanically connecting an electronic module in a rack, said electronic module comprising a front face and a rear face, the rack comprising an opening of dimensions close to those of the front face and a seat for fixing and connecting said module, said connection device comprising:

- a first male connector and a second male connector mounted on the rear face of the electronic module;
- a first female connector and a second female connector mounted on the fixing seat of the rack, the first female connector complementing the first male connector and the second female connector complementing the second male connector, characterized in that:

- the second female connector is mounted in a structure comprising:
  - first mechanical means for self-centring said second female connector within a clearance range in the three dimensions of space greater than the mechanical positioning tolerances of the second male connector and;
  - elastic means arranged so as to hold said second female connector in position in said clearance range;
- the rear face of the module comprises second centring means complementing said first mechanical self-centring means, so as to be able to ensure the electrical connection of the second male connector blind when the electronic module is mounted in the rack, its front face resting on the opening.

Advantageously, the first mechanical self-centring means comprise two centring feet arranged on either side of the second female connector and in that the second centring means comprise two orifices matched to said centring feet and in that the elastic means are two compression springs mounted on the axes of the two centring feet.

Advantageously, the first male connector is fixed without play on the rear face of the electronic module and in that the first female connector is mounted without play on the fixing seat of the rack, the electronic module comprising, on these lateral faces, positioning and guiding grooves.

The invention relates also to an aircraft instrument panel display system, comprising at least one electronic module and one instrument panel comprising a fixing rack, said electronic module and said rack being equipped with an electrical and mechanical connection device as defined above.

BRIEF DESCRIPTION OF THE DRAWINGS

The invention will be better understood and other advantages will become apparent on reading the following description, given in a non-limiting manner, and by virtue of the attached figures in which.

DETAILED DESCRIPTION

Figure 1:
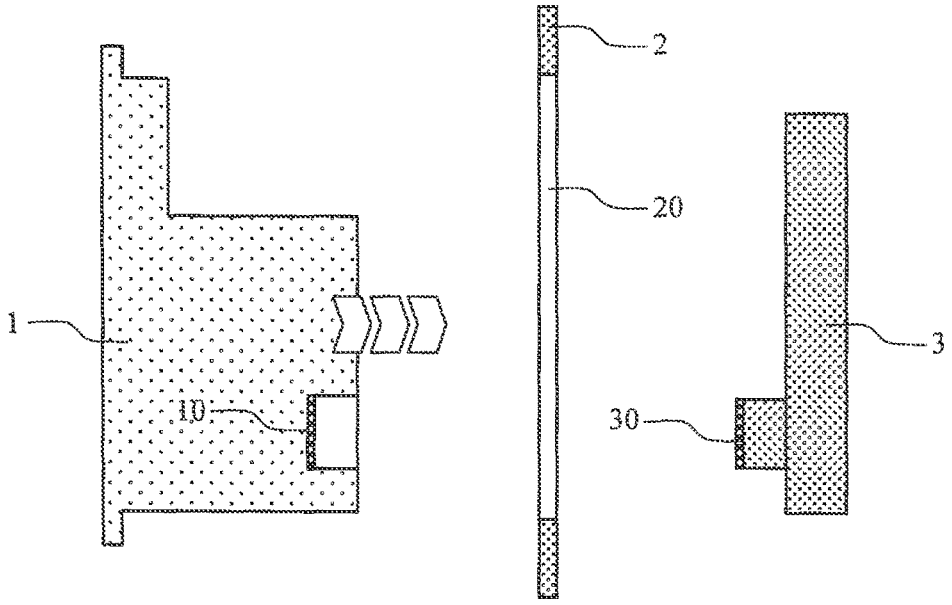
FIG. 1 (Prior Art)
FIG. 1 represents a first electrical connection device for an electronic equipment item in a rack according to the prior art.
Figure 2:
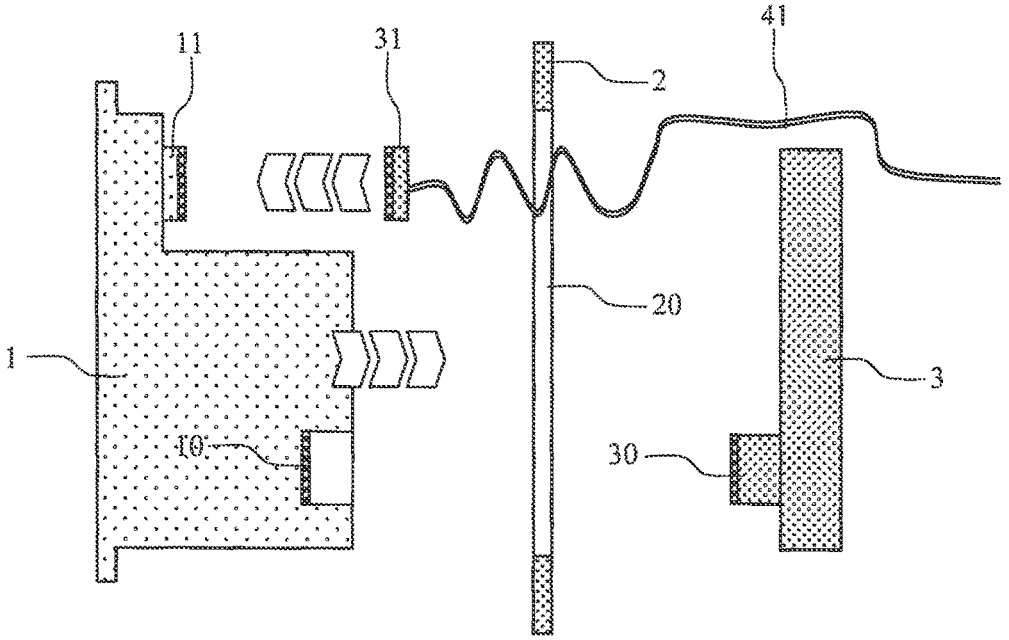
FIG. 2 (Prior Art)
FIG. 2 represents a second electrical connection device for an electronic equipment item in a rack according to the prior art.
Figure 3:
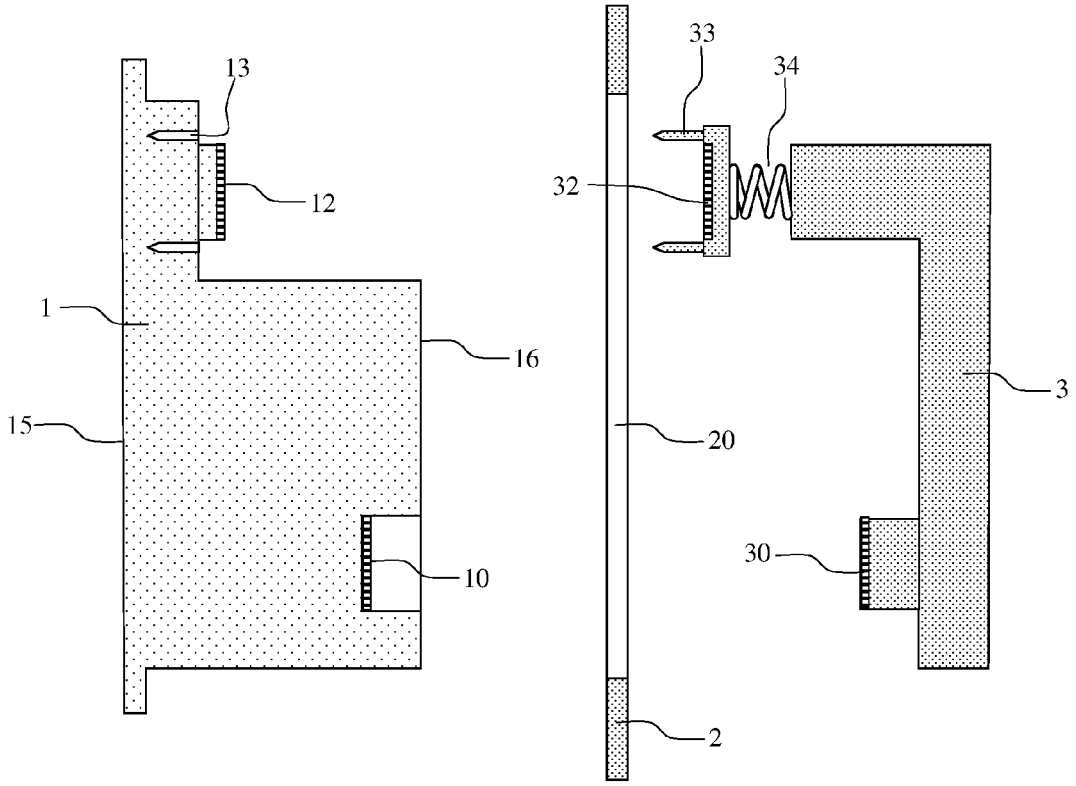
FIG. 3 represents an electrical connection device for an electronic equipment item in a rack according to the invention.

By way of non-limiting example, FIG. 3 represents the diagram of a device for electrically and mechanically connecting an electronic module 1 in a rack 2. The electronic module 1 comprises a front face 15 and a rear face 16. The rack 2 comprises an opening 20 of dimensions close to those of the front face and a seat 3 for fixing and connecting the electronic module 1.

The connection device according to the invention comprises a first male connector 10 and a second male connector 12 mounted on the rear face 16 of the electronic module. These second connectors, for electronic sitting reasons, are not necessarily in the same plane. The connection device also comprises a first female connector 30 and a second female connector 32 mounted on the fixing seat 3 of the rack. The first female connector 30 complements the first male connector 10 and the second female connector 32 complements the second male connector 12.

The second female connector 32 is mounted in a mechanical structure comprising mechanical means 33 for self-centring within a clearance range in the three dimensions of space greater than the mechanical positioning tolerances of the second male connector 12.

In effect, one of the difficulties in sitting this second connector 32 is that, if there is a desire to simultaneously connect the two connectors without mechanical adjustments, then the positioning tolerances of the second connector relative to the first connector are very small and cannot be easily held on simple mechanical modules without considerably increasing the production and mounting difficulties. These difficulties are further increased when the connectors are positioned in different planes.

Generally, only the first male connector is fixed without play on the rear face of the electronic module and the first female connector is also mounted without play on the fixing seat of the rack, the electronic module comprising, on these lateral faces, positioning and guiding grooves making it possible to hold to the positioning tolerances of the connector set.

It is therefore preferable for the second female connector to be able to move, at the time of connection, within a certain clearance range. Typically, the clearance ranges lie between one and three millimeters.

Figure 4:
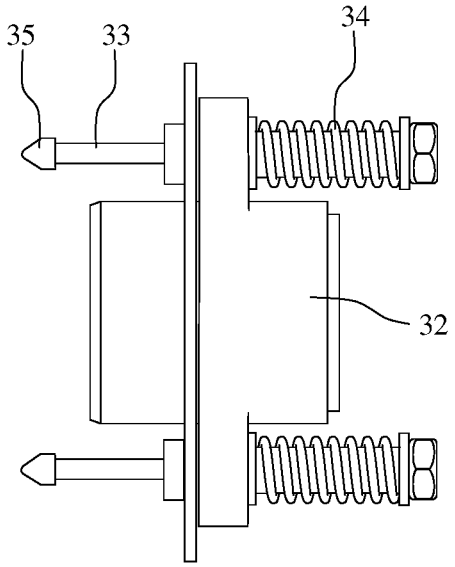
FIG. 4 represents a detail view of an electrical connector set equipped according to the invention.

By way of example, as can be seen in the detail view of FIG. 4, the mechanical centring means 33 are generally two identical centring feet, parallel to one another, arranged on either side of the connector 32. Each centring foot 33 is terminated by a tapered spike 35 which facilitates the guiding of the centring foot at the time of connection.

The mechanical structure also comprises elastic means 34. These elastic means provide a dual function. They keep the second female connector in position within the clearance range. They also ensure the securing of the connection. In effect, the sitting of the second male connector is such that, during the connection phase, this second male connector arrives at its connection end stop before the first male connector. The difference in positioning between the two connection end stops is, consequently, taken up by the compression of the elastic means which thus ensure a perfect securing of the connection.

These elastic means are generally compression springs. In FIG. 4, these compression springs 34 are mounted on the axes of the centring feet 33.

The rear face 16 of the electronic module comprises second centring means 13 complementing the first mechanical self-centring means, so as to be able to ensure the electrical connection of the second male connector blind when the electronic module is mounted in the rack, its front face 15 resting on the opening 20. When the centring means are centring feet, the second centring means are holes of a diameter corresponding to those of the centring feet.

Figure 5:
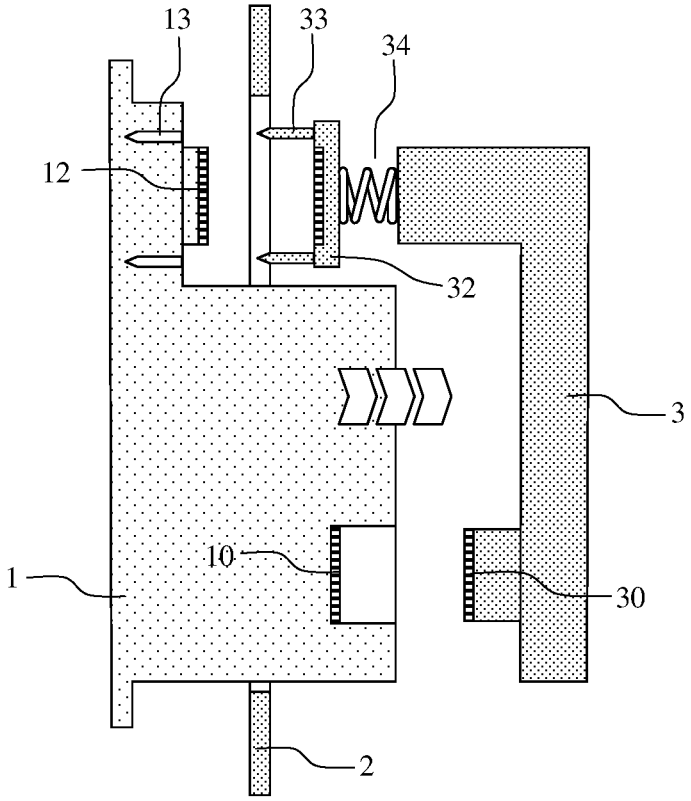
FIGS. 5, 6 and 7 represent the sequence for mounting an electronic equipment item comprising an electrical connection device according to the invention in a rack.
Figure 6:
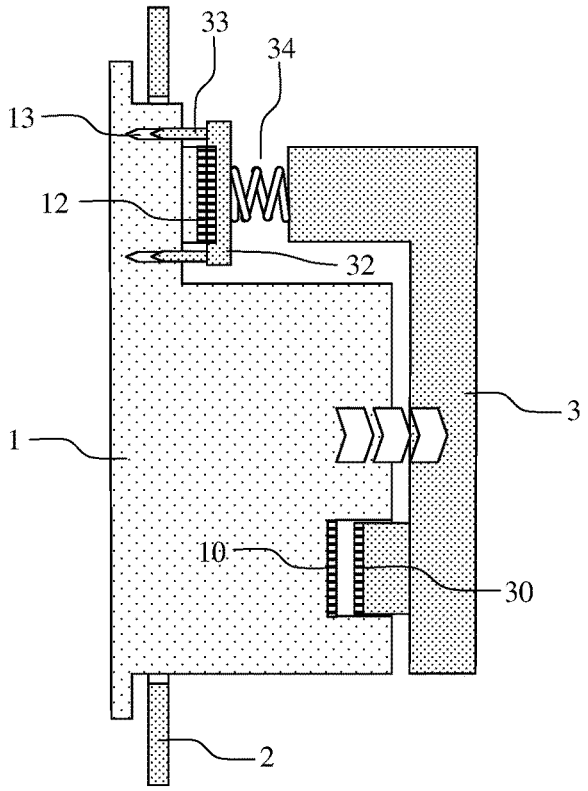
Figure 7:
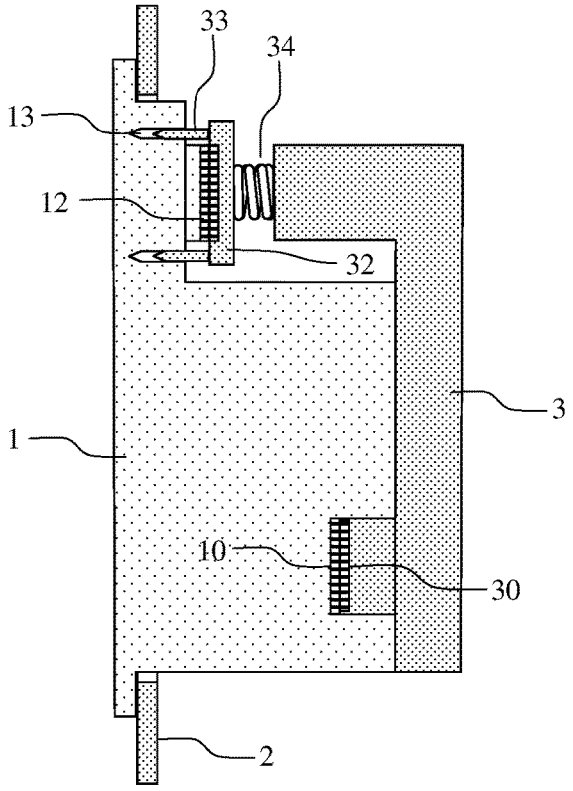

The sequence for installing and electrically connecting the electronic module in its fixing rack is described in FIGS. 5, 6 and 7. In these figures, the triple chevrons indicate the movement of the module at the time of installation of the module.

In FIG. 5, the user begins to introduce the module 1 into the opening 20 of the rack by sliding it on these positioning grooves, not represented in the different figures. The electrical connection is not yet established between the connectors 10 and 30 and the connectors 12 and 32.

In FIG. 6, the user continues to introduce the module 1 into the opening 20 of the rack. Guided by its centring feet 33, the connector 32 connects with the connector 12, the connector 30 begins to connect with the connector 10. When the connector 32 arrives at its end stop in the connector 12, as has been stated, the connector 30 continues to connect in the connector 10, compressing the springs 34 and thus ensuring the securing of the set of connections 30 and 32.

In FIG. 7, the front face of the module is in abutment on the rack 2. The two connections between the connectors 10 and 30 and the connectors 12 and 32 are assured and secured. The module still has to be held in its rack by different fixing means not represented in the different figures. These means are, for example, a fixing handle or fixing screws. The disconnecting of the module is done easily by following the reverse of the connection sequence.

The device according to the invention can notably be applied to aircraft instrument panel display systems. In this application, the electronic module is a display device and the rack is the fixing rack of the aircraft instrument panel. In this context, the first connector is the main connector of the electronic module and the second connector is a secondary connector dedicated to the connection of an accessory such as, for example, an optional touch pad.

What is claimed is:

1. A device for electrically and mechanically connecting an electronic module in a rack, said electronic module comprising a front face and a rear face, the rack comprising an opening of dimensions close to those of the front face and a seat for fixing and connecting said module, said connection device comprising:

- a first male connector and a second male connector mounted on the rear face of the electronic module;
- a first female connector and a second female connector mounted on the fixing seat of the rack, the first female connector complementing the first male connector and the second female connector complementing the second male connector, wherein:

the first male connector and the second male connector are mounted on the rear face of the electronic module in different planes;

the second female connector is mounted in a structure comprising:

first mechanical means for self-centring said second female connector within a clearance range in the three dimensions of space greater than the mechanical positioning tolerances of the second male connector and;

elastic means arranged so as to hold said second female connector in position in said clearance range;

the rear face of the module comprises second centring means complementing said first mechanical self-centring means, so as to be able to ensure the electrical connection of the second male connector blind when the electronic module is mounted in the rack, its front face resting on the opening.

2. The electrical connection device according to claim 1, wherein the first mechanical self-centring means comprise two centring feet arranged on either side of the second female connector and wherein the second centring means comprise two orifices matched to said centring feet and wherein the elastic means are two compression springs mounted on the axes of the two centring feet.

3. The electrical connection device according to claim 1, wherein the first male connector is fixed without play on the rear face of the electronic module and wherein the first female connector is mounted without play on the fixing seat of the rack, the electronic module comprising, on these lateral faces, positioning and guiding grooves.

4. An aircraft instrument panel display system, comprising at least one electronic module and one instrument panel comprising a fixing rack, wherein said electronic module and said rack are equipped with a device for electrically and mechanically connecting the electronic module in the rack, said electronic module comprising a front face and a rear face, the rack comprising an opening of dimensions close to those of the front face and a seat for fixing and connecting said module, said connection device comprising:

a first male connector and a second male connector mounted on the rear face of the electronic module;

a first female connector and a second female connector mounted on the fixing seat of the rack, the first female connector complementing the first male connector and the second female connector complementing the second male connector, wherein:

the first male connector and the second male connector are mounted on the rear face of the electronic module in different planes;

the second female connector is mounted in a structure comprising:

first mechanical means for self-centring said second female connector within a clearance range in the three dimensions of space greater than the mechanical positioning tolerances of the second male connector and;

elastic means arranged so as to hold said second female connector in position in said clearance range;

the rear face of the module comprises second centring means complementing said first mechanical self-centring means, so as to be able to ensure the electrical connection of the second male connector blind when the electronic module is mounted in the rack, its front face resting on the opening.

* * * * *